US011060441B2

(12) United States Patent
Hewing et al.

(10) Patent No.: US 11,060,441 B2
(45) Date of Patent: Jul. 13, 2021

(54) WATER PUMP WITH TWIN RETURN PORTS

(71) Applicant: Perkins Engines Company Limited, Peterborough (GB)

(72) Inventors: Marc B. Hewing, Oadby (GB); Jonathan Lee Gumbrell, Ufford (GB)

(73) Assignee: Perkins Engines Company Limited, Peterborough (GB)

( * ) Notice: Subject to any disclaimer, the term of this patent is extended or adjusted under 35 U.S.C. 154(b) by 123 days.

(21) Appl. No.: 16/376,262

(22) Filed: Apr. 5, 2019

(65) Prior Publication Data

US 2020/0318528 A1 Oct. 8, 2020

(51) Int. Cl.

| | |
|---|---|
| ***F01P 7/16*** | (2006.01) |
| ***F01P 5/10*** | (2006.01) |
| ***F01P 11/04*** | (2006.01) |
| *F01P 3/12* | (2006.01) |

(52) U.S. Cl.

CPC ..... *F01P 7/16* (2013.01); *F01P 5/10* (2013.01); *F01P 11/04* (2013.01); *F01P 3/12* (2013.01)

(58) Field of Classification Search

CPC ..... F01P 5/10; F01P 11/04; F01P 3/12; F04D 29/4293; F04D 29/406; F04D 29/426; F04D 29/60; F04D 29/605; F04D 29/007

See application file for complete search history.

(56) References Cited

U.S. PATENT DOCUMENTS

| | | | | |
|---|---|---|---|---|
| 2,903,991 | A * | 9/1959 | Carlson | F01P 3/202 440/88 R |
| 3,163,157 | A * | 12/1964 | Connell | F01P 5/10 123/41.09 |
| 3,704,078 | A * | 11/1972 | Conery | F04D 29/426 417/369 |
| 3,730,147 | A * | 5/1973 | Buchwald | F02B 67/06 123/41.44 |
| 4,938,185 | A * | 7/1990 | Doke | F01P 5/10 123/195 C |
| 6,250,875 | B1 * | 6/2001 | Bauer | F01P 5/10 415/10 |
| 6,257,177 | B1 | 7/2001 | Lehmann | |
| 6,260,515 | B1 * | 7/2001 | Tosaka | F01P 5/10 123/41.08 |
| 6,305,332 | B1 * | 10/2001 | Nishi | F02B 27/0215 123/41.29 |
| 6,405,689 | B1 * | 6/2002 | Iijima | F01P 3/02 123/41.28 |
| 6,631,780 | B1 * | 10/2003 | Hori | F01M 1/02 180/292 |
| 6,843,209 | B2 * | 1/2005 | Miyagawa | F01P 5/10 123/41.1 |
| 8,459,389 | B2 | 6/2013 | Myers et al. | |

(Continued)

FOREIGN PATENT DOCUMENTS

| | | |
|---|---|---|
| DE | 102005057712 A1 | 8/2006 |
| DE | 102017206939 A1 | 10/2018 |

(Continued)

*Primary Examiner* — Hung Q Nguyen

(57) ABSTRACT

A water pump housing includes a top horizontal pad defining a top horizontal pad normal axis pointing vertically, and a first return port and a second return port extending down vertically from the top horizontal pad.

18 Claims, 4 Drawing Sheets

(56) References Cited

U.S. PATENT DOCUMENTS

2003/0029394 A1* 2/2003 Miyagawa ..... F01P 5/10 123/41.54
2004/0191062 A1* 9/2004 Dahlheimer ..... D06F 39/085 415/231
2004/0237912 A1* 12/2004 Pawellek ..... F16K 11/0743 123/41.44
2004/0250789 A1* 12/2004 Morii ..... F01M 1/12 123/192.2
2007/0074681 A1* 4/2007 Shiozaki ..... F02F 7/007 123/41.1
2008/0066696 A1* 3/2008 Hirayama ..... F01P 11/0285 123/41.44
2014/0060465 A1* 3/2014 Iida ..... F02B 61/02 123/41.47
2014/0261258 A1* 9/2014 Fronk ..... F01L 1/053 123/41.47
2015/0071774 A1* 3/2015 Akiyama ..... F04D 9/002 415/206
2015/0157004 A1* 6/2015 Hiddema ..... F04D 29/026 239/159
2015/0277448 A1* 10/2015 Shimamura ..... F04D 15/0218 137/390
2017/0030252 A1* 2/2017 Richter ..... F01P 11/0285
2017/0218808 A1* 8/2017 Kurokawa ..... B60K 11/02
2017/0218822 A1* 8/2017 Yamashita ..... F01P 5/10
2017/0234205 A1* 8/2017 Sugiura ..... F01P 5/12 417/380
2018/0038268 A1* 2/2018 Kloft ..... F01P 3/20
2018/0172009 A1* 6/2018 Hill ..... F01P 7/167
2018/0223721 A1* 8/2018 Matsushita ..... F01P 7/162
2018/0230893 A1* 8/2018 Sato ..... F01P 7/161
2019/0136744 A1* 5/2019 LaRochelle ..... F01P 5/10
2020/0158351 A1* 5/2020 Blad ..... F04D 29/4293
2020/0315061 A1* 10/2020 Franz ..... F04D 29/586

FOREIGN PATENT DOCUMENTS

JP 62199921 A * 9/1987 ..... F01P 7/16
JP 2000087748 A * 3/2000 ..... F01P 5/10
WO 9854448 W 12/1998
WO 2007124812 A1 11/2007
WO WO-2015146832 A1 * 10/2015 ..... F02F 7/007
WO 2018065155 A1 4/2018
WO 2018166969 A1 9/2018

* cited by examiner

WATER PUMP WITH TWIN RETURN PORTS

TECHNICAL FIELD

The present disclosure relates to water pumps used in engine assemblies and the like. Specifically, the present disclosure relates to a water pump with twin return ports.

BACKGROUND

Engine assemblies often employ water pumps that supply water to the cooling system of the engine assembly. Some water pumps only have one top return port within the casting body that may be used as the thermostat water return. In some applications, it is also desirable to provide water to a cab heater water, etc. Water pumps currently do not facilitate supplying water to multiple systems, especially when having branched hoses is difficult due to space constraints.

For example, U.S. Pat. No. 6,257,177 to Lehmann discloses a water pump for the cooling circuit of an internal combustion engine. The water pump includes a pump housing and a pump device driven in the pump housing. A servo valve having a rotary gate is integrated into the pump housing. The rotary gate is approximately sleeve-shaped and is provided with an axial main opening for supply or discharge of cooling medium to the suction or pressure side of the pump device. Inlet and discharge openings for a cooler line connected to a cooler for at least one additional partial circuit are provided in the peripheral wall of the pump housing. The rotary gate has on its peripheral wall a control opening with an opening width through which a connection from the main opening is created to an individual inlet or discharge opening, or an overlapping connection is created to two adjacent inlet or discharge openings for mixed operation.

As can be seen, Lehmann does not adequately address the aforementioned problems since it does not teach how to allow a water pump to supply multiple systems simultaneously without using complicated hose arrangements, etc.

SUMMARY

An engine assembly according to an embodiment of the present disclosure comprises a water pump including a first return port and a second return port, a first connector extending from the first return port and a second connector extending from the second return port, and a first hose attached to the first connector and extending away from the water pump.

A water pump according to an embodiment of the present disclosure comprises a first return port and a second return port, and a first connector extending from the first return port and a second connector extending from the second return port.

A water pump housing according to an embodiment of the present disclosure includes a top horizontal pad defining a top horizontal pad normal axis pointing vertically, and a first return port and a second return port extending down vertically from the top horizontal pad.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
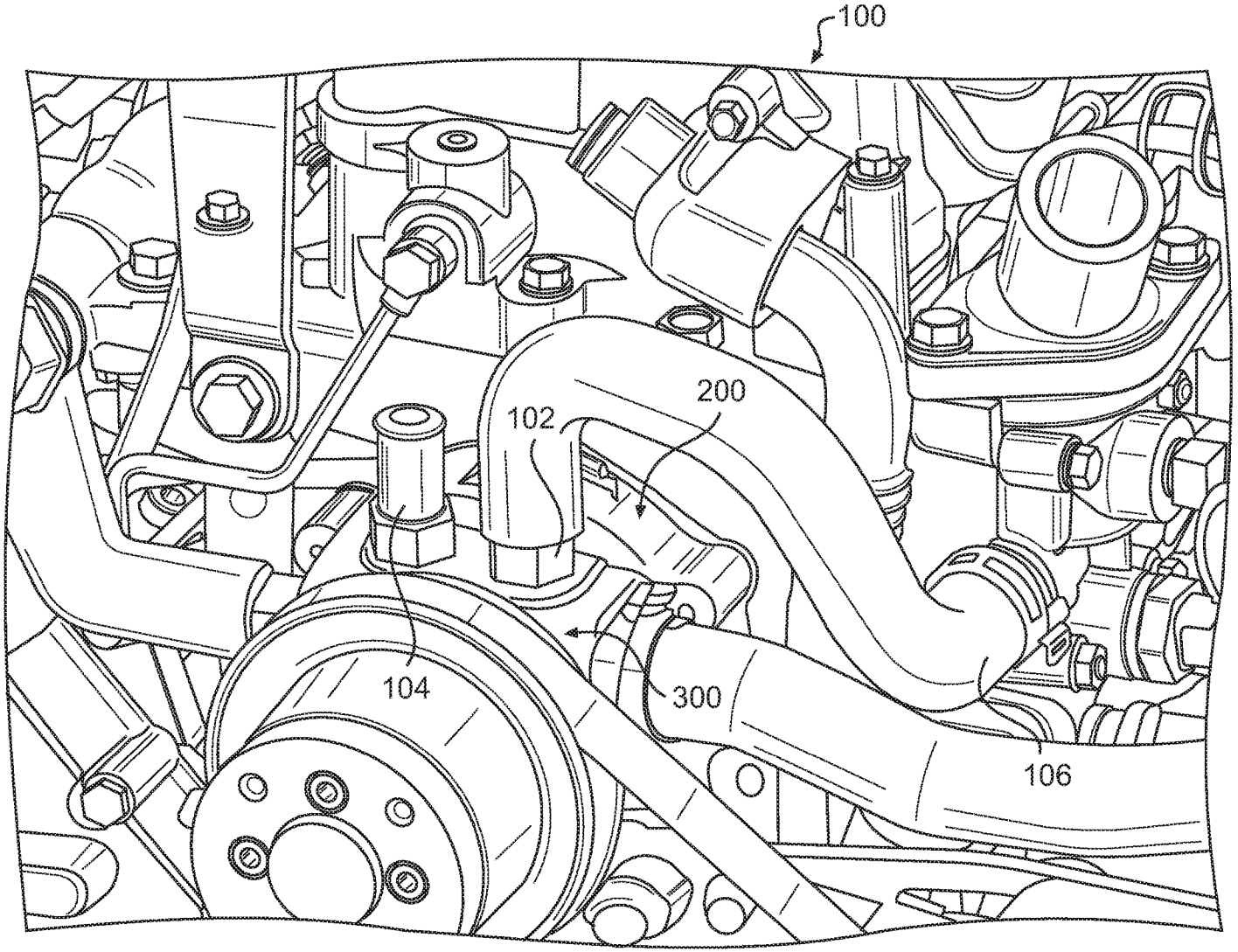
FIG. 1 is a perspective view of an engine assembly showing the use of a water pump with twin return ports according to an embodiment of the present disclosure.
Figure 2:
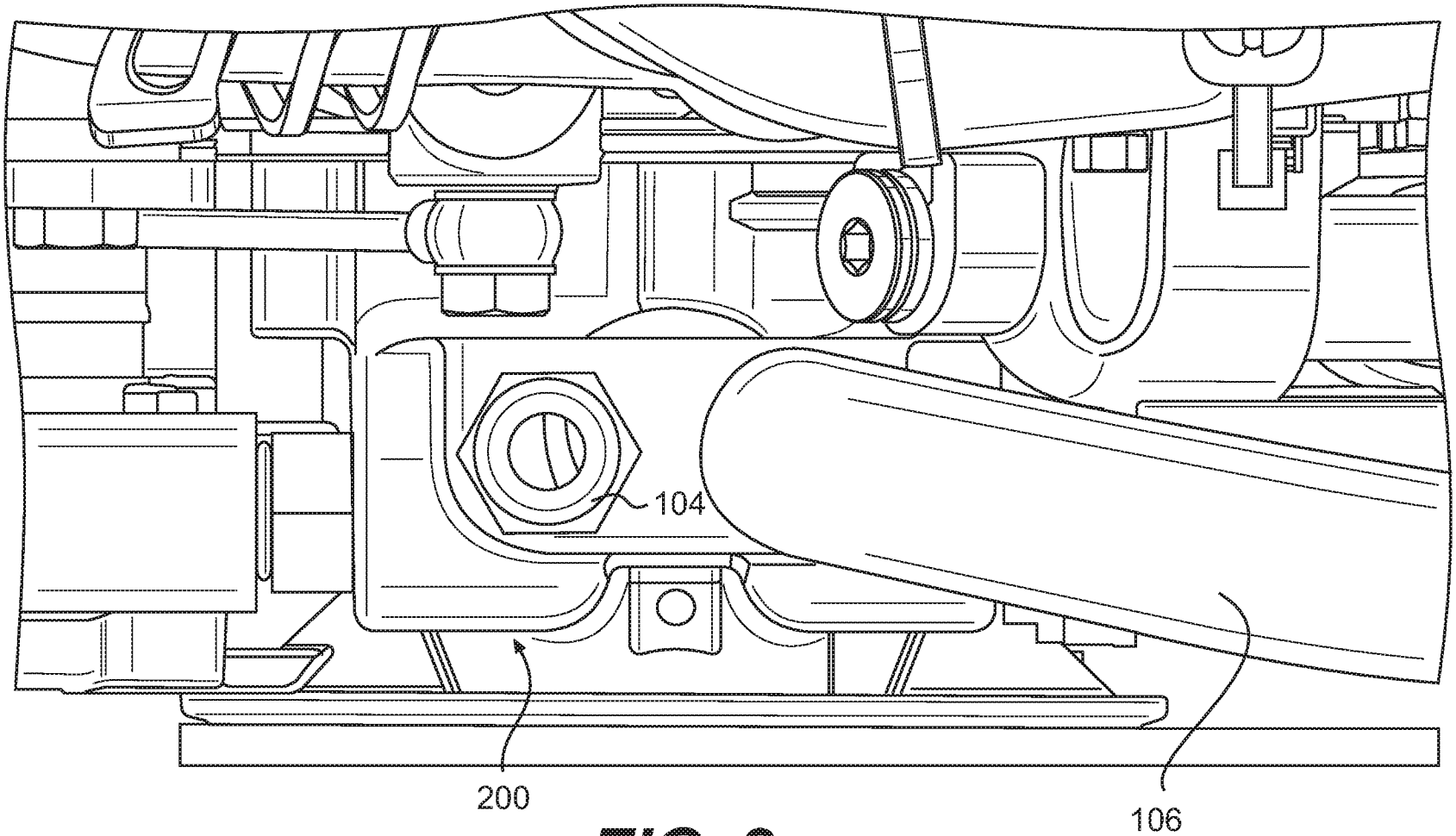
FIG. 2 is a top view of the engine assembly of FIG. 1.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or by a prime for example, 100', 100" etc. It is to be understood that the use of letters or primes immediately after a reference number indicates that these features are similarly shaped and have similar function as is often the case when geometry is mirrored about a plane of symmetry. For ease of explanation in this specification, letters and primes will often not be included herein but may be shown in the drawings to indicate duplications of features, having similar or identical function or geometry, discussed within this written specification.

Various embodiments of an engine assembly, a water pump, and a water pump housing according to various principles of the present disclosure will now be discussed. For example, the pump housing may have two side by side ports to allow two sets of hose fittings (may also be referred to as connectors) to be used. One of the return ports may be used for thermostat and one for cab heater, etc. To accommodate two return ports in the water pump, a cast pad may be provided that is long enough so that two side by side return ports are formed in the cast pad to allow two sets of hose fittings to be used.

Looking at FIGS. 1 thru 4, an engine assembly 100 according to an embodiment of the present disclosure may comprise a water pump 200 including a first return port 302 and a second return port 304, a first connector 102 extending from the first return port 302 and a second connector 104 extending from the second return port 304. A first hose 106 may be attached to the first connector 102 and extend away from the water pump 200. A second hose (not shown) may also be attached to the second connector 104.

Figure 3:
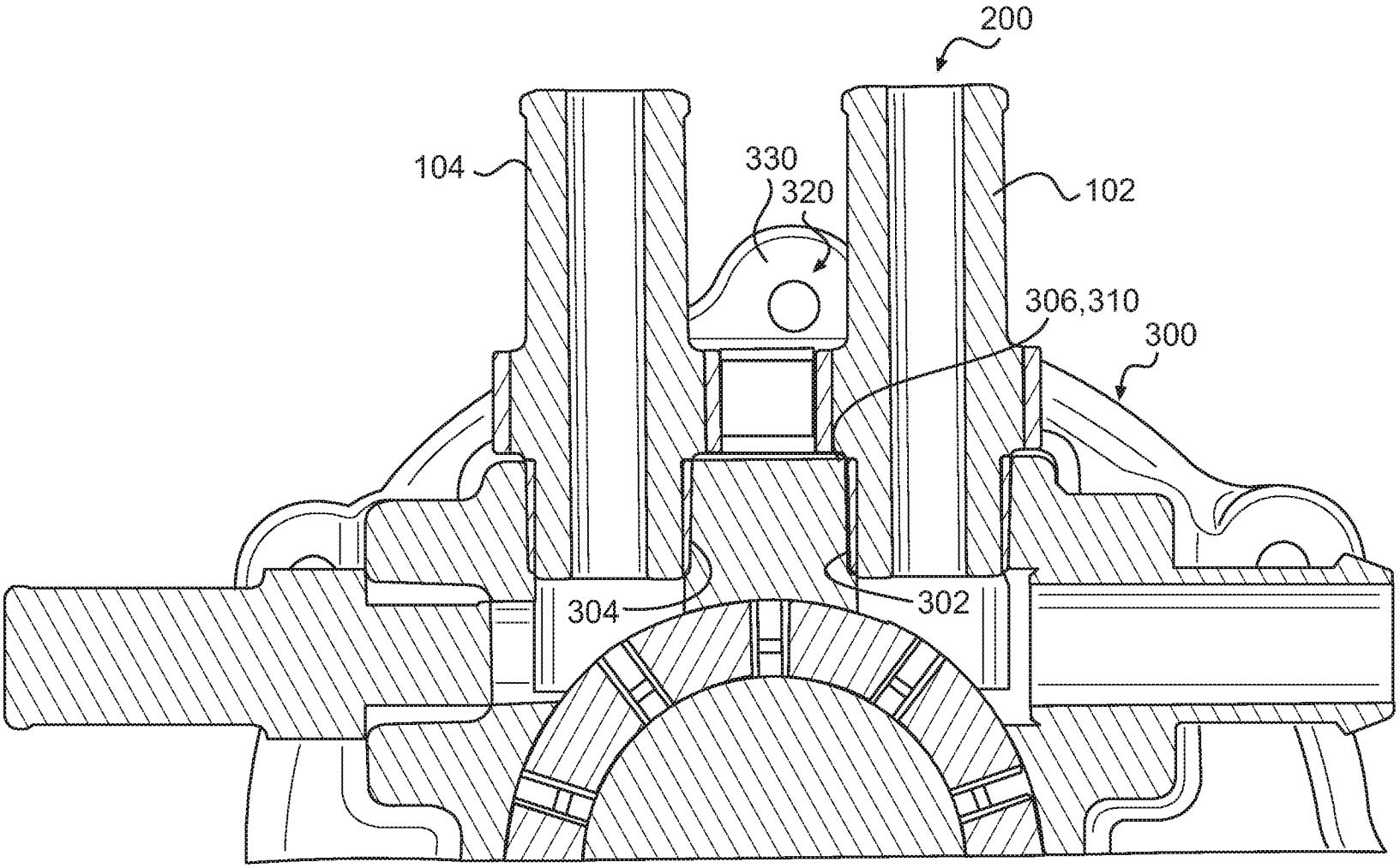
FIG. 3 is a front sectional view of the water pump with twin return ports of the engine assembly of FIG. 1 shown in isolation from the engine assembly with twin connectors extending from the twin return ports.
Figure 4:
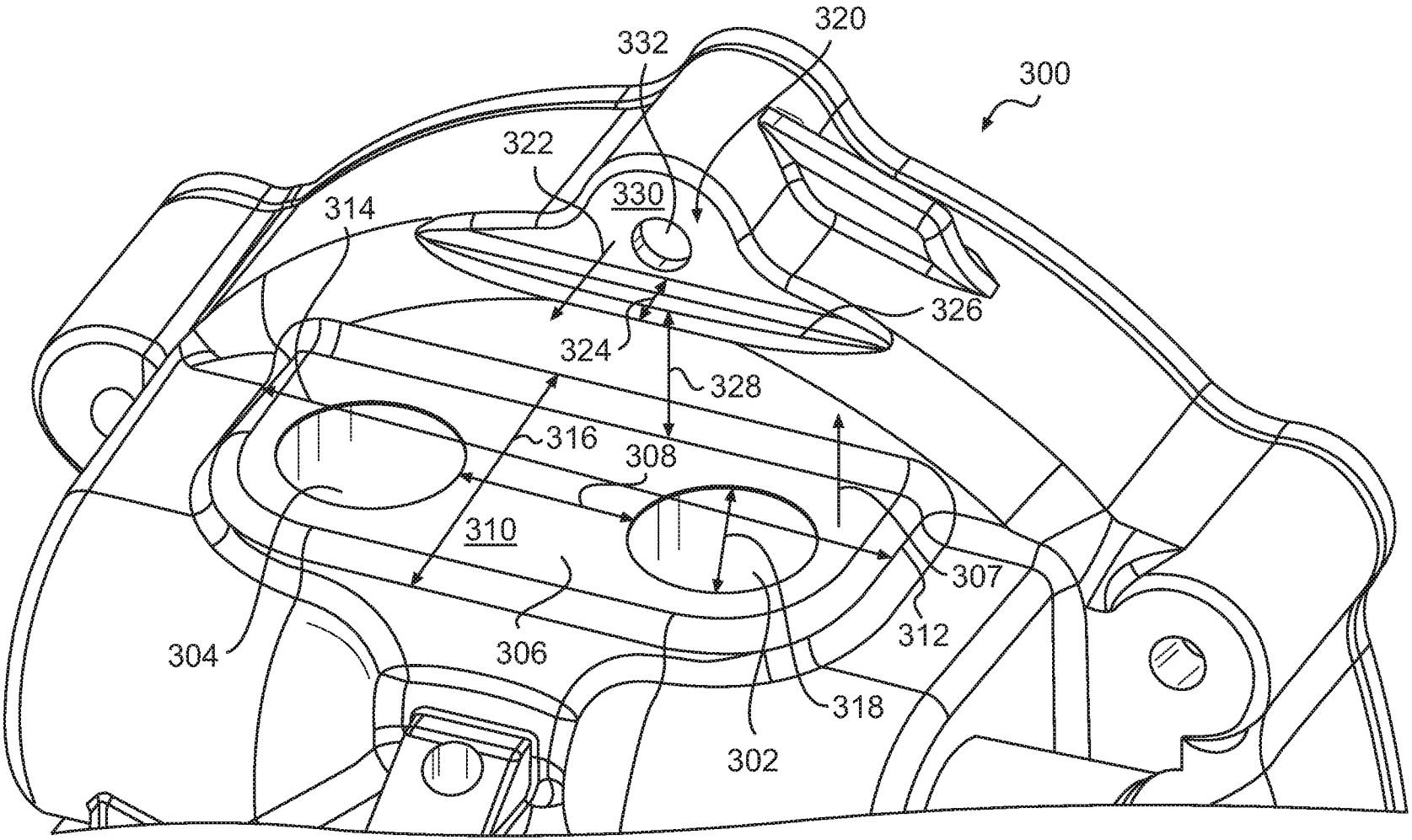
FIG. 4 is an enlarged perspective view of the water pump of FIG. 3 with the twin connectors removed, showing more clearly the twin return ports.

As best seen in FIGS. 3 and 4, the water pump 200 may include a housing 300 comprising a top horizontal pad 306 defining a top horizontal pad normal axis 307 pointing vertically. The first return port 302 and the second return port 304 may extend down vertically from the top horizontal pad 304.

Focusing on FIG. 4, the first return port 302 may be spaced horizontally away from the second return port 304 a horizontal predetermined distance 308 (minimum distance) ranging from 15 mm to 18 mm. The top horizontal pad 306 may include a flat top surface 310, and may have at least a partially rectangular configuration (see perimeter 312). Thus, the top horizontal pad defines a horizontal length 314 ranging from 56 mm to 60 mm, and a horizontal width 316 ranging from 26 mm to 30 mm. Other configurations and dimensions for these features is possible in other embodiments.

Referring again to FIGS. 3 and 4, the first return port 302 and the second return port 304 may be identically configured, and the first connector 102 and the second connector 104 may also be identically configured.

In FIG. 4, the first return port 302 defines a first return port diameter 318 ranging from 14 mm to 16 mm. This dimension may be altered in other embodiments. The first and the second return ports 302, 304 may also have piped tapped threads that are configured to mate with the corresponding threads on the first and the second connectors 102, 104. This may not be the case for other embodiments of the present disclosure. The housing 300 may further define a top vertical pad 320 disposed above the top horizontal pad 306. The top vertical pad 320 may define a top vertical pad normal axis 322 pointing horizontally, and may be spaced away from the top horizontal pad 306 along the top vertical pad normal axis 322 an offset distance 324 ranging from 4 mm to 6 mm, forming a horizontal ledge 326. This feature may provide clearance for a hose clamp (not shown) to be used to attach a hose to a connector. More specifically, the top vertical pad 320 includes a straight vertical surface 330 that defines a mounting hole 332 so that the hose clamp may be attached thereto.

A water pump 200 according to an embodiment of the present disclosure will now be discussed with reference to FIGS. 1 thru 4. The water pump 200 may comprise a first return port 302, a second return port 304, a first connector 102 extending from the first return port 302, and a second connector 104 extending from the second return port 304.

Focusing on FIGS. 3 and 4, the water pump 200 may include a housing 300 comprising a top horizontal pad 306 defining a top horizontal pad normal axis 307 pointing vertically. The first return port 302 and the second return port 304 may extend down vertically from the top horizontal pad 306.

The first return port 302 may be spaced horizontally away from the second return port 304 a horizontal predetermined distance 308 ranging from 15 mm to 18 mm.

The top horizontal pad 306 may include a flat top surface 310, and at least partially includes a rectangular configuration. This configuration may define a horizontal length 314 ranging from 56 mm to 60 mm, and a horizontal width 316 ranging from 26 mm to 30 mm.

As mentioned earlier herein, the first return port 302 and the second return port 304 may be identically configured, and the first connector 102 and the second connector 104 may be identically configured. This may not be the case for other embodiments.

In FIG. 4, the first return port 302 defines a first return port diameter 318 ranging from 14 mm to 16 mm. Furthermore, the housing 300 may further include a top vertical pad 320 disposed above the top horizontal pad 306 that defines a top vertical pad normal axis 322 pointing horizontally. The top vertical pad 320 may be spaced away from the top horizontal pad 306 along the top vertical pad normal axis 322 an offset distance 324 ranging from 4 mm to 6 mm, forming a horizontal ledge 326. This may not be the case in other embodiments.

With continued reference to FIGS. 3 and 4, a water pump housing 300 according to an embodiment of the present disclosure may comprise a top horizontal pad 306 defining a top horizontal pad normal axis 307 pointing vertically, and a first return port 302 and a second return port 304 extending down vertically from the top horizontal pad 306.

Focusing on FIG. 4, the first return port 302 may be spaced horizontally away from the second return port 304 a horizontal predetermined distance 308 ranging from 15 mm to 18 mm. The top horizontal pad 306 may include a flat top surface 310 at least partially defining the first return port 302 and the second return port 304. The top horizontal pad 306 may have an at least partially rectangular configuration, defining a horizontal length 314 ranging from 56 mm to 60 mm, and a horizontal width 316 ranging from 26 mm to 30 mm. Other configurations and dimensions for these various features are possible in other embodiments.

As alluded to earlier herein, the first return port 302 and the second return port 304 may be identically configured.

The first return port may define a first return port diameter ranging from 14 mm to 16 mm. Other configurations and dimensions for these various features are possible in other embodiments.

In FIG. 4, the housing 300 may further include a top vertical pad 320 disposed above the top horizontal pad 306 that defines a top vertical pad normal axis 322 pointing horizontally. The top vertical pad 320 may be spaced away from the top horizontal pad 306 along the top vertical pad normal axis 322 an offset distance 324 ranging from 4 mm to 6 mm, forming a horizontal ledge 326. This may not be the case in other embodiments. Moreover, the horizontal ledge 326 may be spaced away along the top horizontal pad normal axis 307 from the flat top surface 310 of the top horizontal pad 306 a vertical distance 328 ranging from 8 mm to 10 mm. This may not be the case in other embodiments.

The water pump housing 300 may be cast or molded from any suitable material including, but not limited to, steel, aluminum, iron, and thermoplastics.

Any of the dimensions, configurations, materials, etc. discussed herein may be varied as needed or desired to be different than any value or characteristic specifically mentioned herein or shown in the drawings for any of the embodiments.

INDUSTRIAL APPLICABILITY

In practice, an engine assembly, a water pump, and/or a water pump housing using any embodiment disclosed herein may be sold, bought, manufactured or otherwise obtained in an OEM (original equipment manufacturer) or after-market context. In some cases, various components, of the engine assembly, water pump, and water pump housing, etc. may be provided as a kit.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. An engine assembly comprising:

a water pump including a first return port and a second return port;

a first connector extending from the first return port and a second connector extending from the second return port; and a first hose attached to the first connector and extending away from the water pump;

wherein the water pump further includes a housing comprising a top horizontal pad defining a top horizontal pad normal axis pointing vertically, and the first return port and the second return port extend down vertically from the top horizontal pad; and the housing further defines a top vertical pad disposed above the top horizontal pad and defining a top vertical pad normal axis pointing horizontally, the top vertical pad being spaced away from the top horizontal pad along the top vertical pad normal axis an offset distance, forming a horizontal ledge.

2. The engine assembly of claim 1 wherein the first return port is spaced horizontally away from the second return port a horizontal predetermined distance ranging from 15 mm to 18 mm.

3. The engine assembly of claim 2 wherein the top horizontal pad includes a flat top surface, an at least partially rectangular configuration, and defines a horizontal length ranging from 56 mm to 60 mm, and a horizontal width ranging from 26 mm to 30 mm.

4. The engine assembly of claim 1 wherein the first return port and the second return port are identically configured, and the first connector and the second connector are identically configured.

5. The engine assembly of claim of claim 4 wherein the first return port defines a first return port diameter ranging from 14 mm to 16 mm.

6. The engine assembly of claim 1 wherein the offset distance ranges from 8 mm to 10 mm.

7. A water pump comprising:

a first return port and a second return port;

a first connector extending from the first return port and a second connector extending from the second return port; and a housing comprising a top horizontal pad defining a top horizontal pad normal axis pointing vertically, and the first return port and the second return port extend down vertically from the top horizontal pad; and the housing further defines a top vertical pad disposed above the top horizontal pad and defining a top vertical pad normal axis pointing horizontally, the top vertical pad being spaced away from the top horizontal pad along the top vertical pad normal axis an offset distance, forming a horizontal ledge.

8. The water pump of claim 7 wherein the first return port is spaced horizontally away from the second return port a horizontal predetermined distance ranging from 15 mm to 18 mm.

9. The water pump of claim 8 wherein the top horizontal pad includes a flat top surface, an at least partially rectangular configuration, and defines a horizontal length ranging from 56 mm to 60 mm, and a horizontal width ranging from 26 mm to 30 mm.

10. The water pump of claim 7 wherein the first return port and the second return port are identically configured, and the first connector and the second connector are identically configured.

11. The water pump of claim of claim 10 wherein the first return port defines a first return port diameter ranging from 14 mm to 16 mm.

12. The water pump of claim 7 wherein the offset distance ranges from 8 mm to 10 mm.

13. A water pump housing comprising:

a top horizontal pad defining a top horizontal pad normal axis pointing vertically, and a first return port and a second return port extending down vertically from the top horizontal pad;

wherein the top horizontal pad includes a flat top surface at least partially defining the first return port and the second return port, an at least partially rectangular configuration, and the housing further defines a top vertical pad disposed above the top horizontal pad and defining a top vertical pad normal axis pointing horizontally, the top vertical pad being spaced away from the top horizontal pad along the top vertical pad normal axis an offset distance, forming a horizontal ledge.

14. The water pump housing of claim 13 wherein the first return port is spaced horizontally away from the second return port a horizontal predetermined distance ranging from 15 mm to 18 mm, and the top horizontal pad defines a horizontal length ranging from 56 mm to 60 mm, and a horizontal width ranging from 26 mm to 30 mm.

15. The water pump housing of claim 13 wherein the first return port and the second return port are identically configured.

16. The water pump housing of claim 13 wherein the first return port defines a first return port diameter ranging from 14 mm to 16 mm.

17. The water pump housing of claim 13 wherein the offset distance ranges from 8 mm to 10 mm.

18. The water pump housing of claim 17 wherein the horizontal ledge is spaced away along the top horizontal pad normal axis from the flat top surface of the top horizontal pad a vertical distance ranging from 8 mm to 10 mm.

* * * * *